US005088409A

United States Patent [19]

Roskosch

[11] Patent Number: 5,088,409

[45] Date of Patent: Feb. 18, 1992

[54] DEVICE FOR ADJUSTING A FLEXIBLE PRINTING PLATE ON A PLATE CYLINDER OF A ROTARY PRINTING PRESS

[75] Inventor: Bernhard Roskosch, Leimen, Fed. Rep. of Germany

[73] Assignee: Heidelberger Druckmaschinen AG, Heidelberg, Fed. Rep. of Germany

[21] Appl. No.: 526,902

[22] Filed: May 21, 1990

[30] Foreign Application Priority Data

Jun. 3, 1989 [DE] Fed. Rep. of Germany ..... 3918215

[51] Int. Cl.[5] ..... B41F 1/28

[52] U.S. Cl. ..... 101/415.1; 101/378

[58] Field of Search ..... 101/415.1, 378, DIG. 36

[56] References Cited

U.S. PATENT DOCUMENTS

| | | | |
|---|---|---|---|
| 4,459,913 | 7/1984 | Kowalik | 101/415.1 |
| 4,712,476 | 12/1987 | Jeschke | 101/415.1 |
| 4,785,736 | 11/1988 | Jeschke | 101/415.1 |
| 4,831,931 | 5/1989 | Jeschke et al. | 101/415.1 |
| 4,862,800 | 9/1989 | Wieland et al. | 101/415.1 |

*Primary Examiner*—Edgar S. Burr
*Assistant Examiner*—Joseph R. Keating
*Attorney, Agent, or Firm*—Nils H. Ljungman & Associates

[57] ABSTRACT

A device for adjusting a flexible printing plate on a plate cylinder of a rotary printing press includes clamping rails, whereby both ends of the plate are clamped in the clamping rails. The clamping rails are connected in an articulated manner at their ends by swivel-mounted levers to means for correcting the plate register by turning the printing plate during the operation of the press.

20 Claims, 3 Drawing Sheets

DEVICE FOR ADJUSTING A FLEXIBLE PRINTING PLATE ON A PLATE CYLINDER OF A ROTARY PRINTING PRESS

BACKGROUND OF THE INVENTION

1. Field of the Invention

The invention relates to a device for adjusting a flexible printing plate on a plate cylinder of a rotary printing press with clamping rails, both ends of the plate being clamped in the clamping rails with swivel-mounted levers, the clamping rails having opposite ends articulated by swivel-mounted levers, with the swivel-mounted levers being swivellably mounted on the cylinder body and with the thus connected clamping rails being adjustable in relation to one another via control means in such a manner that, in order to correct the register, the printing plate is turned about a precisely defined pivot.

2. Background Information

U.S. Pat. No. 4,785,736, corresponding to German Laid Open Patent Application No. 36 04 209, discloses a control cam for turning the printing plate to adjust the position of the printing plate on a plate cylinder of a sheet-fed offset printing machine. The control cam acts on a clamping rail which is connected to a roller lever to displace the clamping rail and pivot the printing plate. In this manner, the printing plate is briefly released from the plate cylinder and, after adjustment has been performed, is clamped again on the plate cylinder. This adjustment requires that the inking rollers be briefly disengaged, interrupting operation of the printing press. This may lead to disruptions in the ink-water balance and thus to an undesired change in the printed product.

OBJECT OF THE INVENTION

An object of the present invention is to perform turning of the printing plate on the plate cylinder to provide register correction without interrupting printing during the operation of the printing press.

SUMMARY OF THE INVENTION

In accordance with the present invention, there is provided a device for adjusting a flexible printing plate on a plate cylinder of a rotary printing press that includes a plate cylinder having a cylinder body and a longitudinally extending recess formed in the cylinder body. A flexible printing plate extends around and is supported on the cylinder body. The printing plate has opposite end portions positioned in the recess. A pair of clamping rails are positioned in the recess in abutting relation with the printing plate opposite end portions respectively to clamp the printing plate on the plate cylinder. Swivelable means pivotally mounted on the cylinder body within the recess articulate the clamping rails to change the position of the printing plate on the cylinder body. The swivelable means are connected to the clamping rails. Deflectable means are connected to the cylinder body and the swivelable means for pivoting the swivelable means to transmit a clamping force to the clamping rails. Actuation means connected to the deflectable means displace the deflectable means to turn the swivelable means and articulate the clamping rails to adjust the position of the printing plate on the plate cylinder.

Further, in accordance with the present invention, there is provided a device for adjusting a flexible printing plate on a plate cylinder of a rotary printing press that includes a plate cylinder having a cylinder body and a longitudinally extending recess formed in the cylinder body. A flexible printing plate extends around and is supported on the cylinder body. The printing plate has opposite end portions positioned in the recess. A pair of clamping rails are positioned in the recess in abutting relation with the printing plate opposite end portions respectively to clamp the printing plate on the plate cylinder. A pair of levers are pivotally mounted on the cylinder body within the recess. Means are provided for connecting the levers to the clamping rails such that pivotal movement of a selected one of the levers initiates movement of both of the clamping rails. Displacement means are connected to the levers to turn the levers relative to the plate cylinder with a force sufficient to move the clamping rails to displace the printing plate on the plate cylinder.

In accordance with the present invention there is provided an element for transmitting a clamping force and is positioned between a swivel-mounted lever and a cylinder body. The element is deflectable by an actuating means, such that the swivel-mounted lever is turned by the change in length of the element and, consequently, a pair of clamping rails are adjusted in relation to one another. The deflection of the element transmitting the clamping force results in such a high transfer of force that the plate-clamping rails and thus the printing plate can be turned while the printing plate is in the clamped state. This has the advantage that register adjustment can be carried out during the production run without adversely affecting the lateral or circumferential register adjustment and without requiring the adjustment to be reset. In addition, the plate can, if necessary, be stretched in the circumferential direction for example, to compensate for lengthening of the paper due to contact with the damping solution, without the stretching being adversely affected by a register correction according to the present invention.

In one embodiment of the invention, the element transmitting a clamping force is a bending rod which is deflectable out of a straight line by a servomotor through the intermediary of a threaded spindle with adjusting nut. This makes it possible by remote control to perform small adjustment movements, thus permitting very accurate and precise setting of the register. The use of a bending rod allows a very high transfer of force to be generated.

It is advantageous if the adjusting nut acts approximately in the center of the bending rod.

In a further embodiment of the invention, the bending rod transmits tensile forces and is adjustable at its mounting on the cylinder body. A bending rod that is under tension can be relatively thin in dimension and yet transmit very high forces. Furthermore, in order to eliminate bearing play and to reset the swivel-mounted levers, a spring is provided to counteract the tensile force of the bending rod. Consequently, the entire adjusting mechanism is play- and wear-free and is preferably self-locking.

BRIEF DESCRIPTION OF THE DRAWINGS

One embodiment of the invention is schematically illustrated in the accompanying drawings.

DESCRIPTION OF THE PREFERRED EMBODIMENTS

Figure 1:
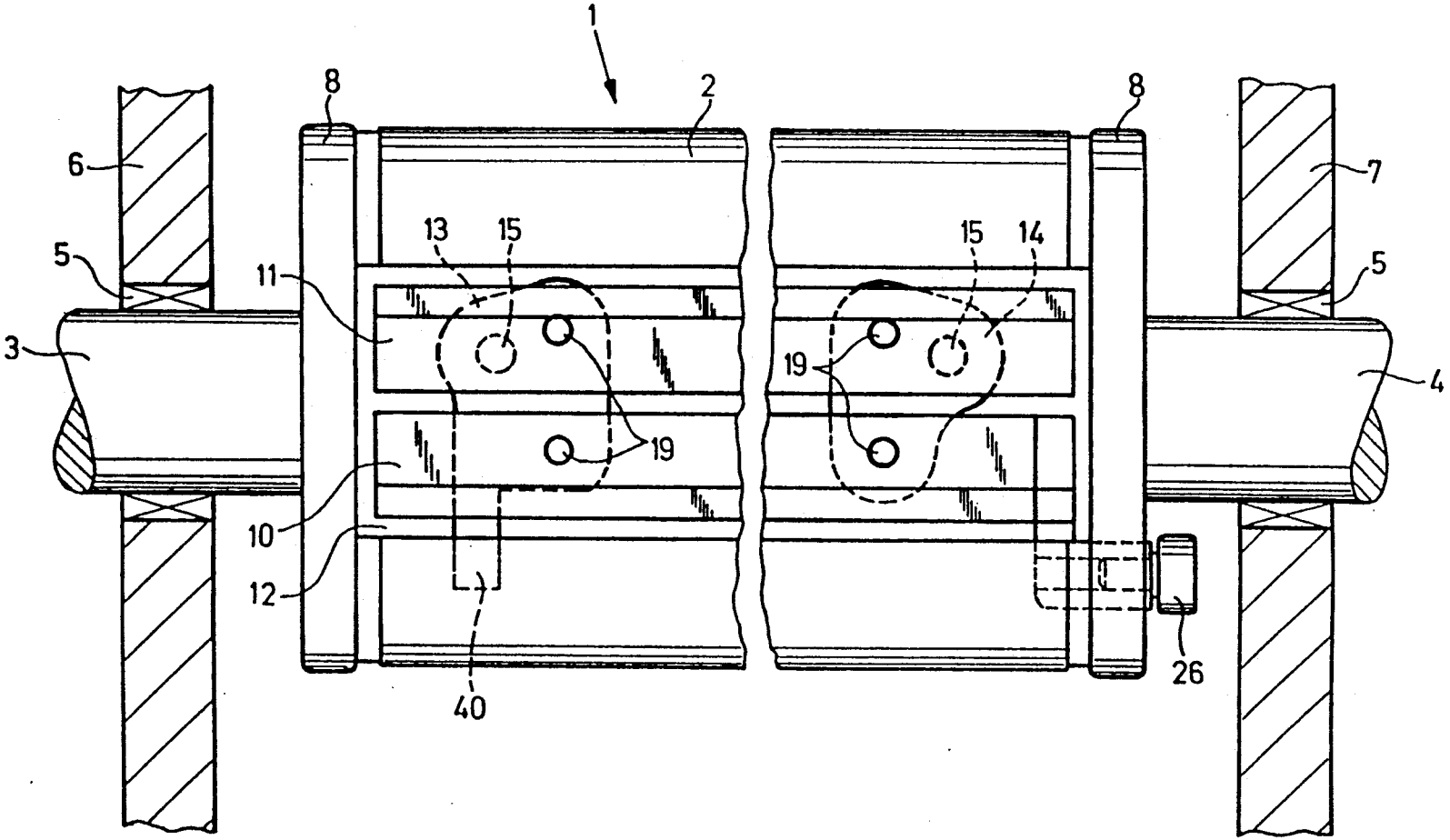
FIG. 1 is a plane view, partially in section, of a plate cylinder.
Figure 3:
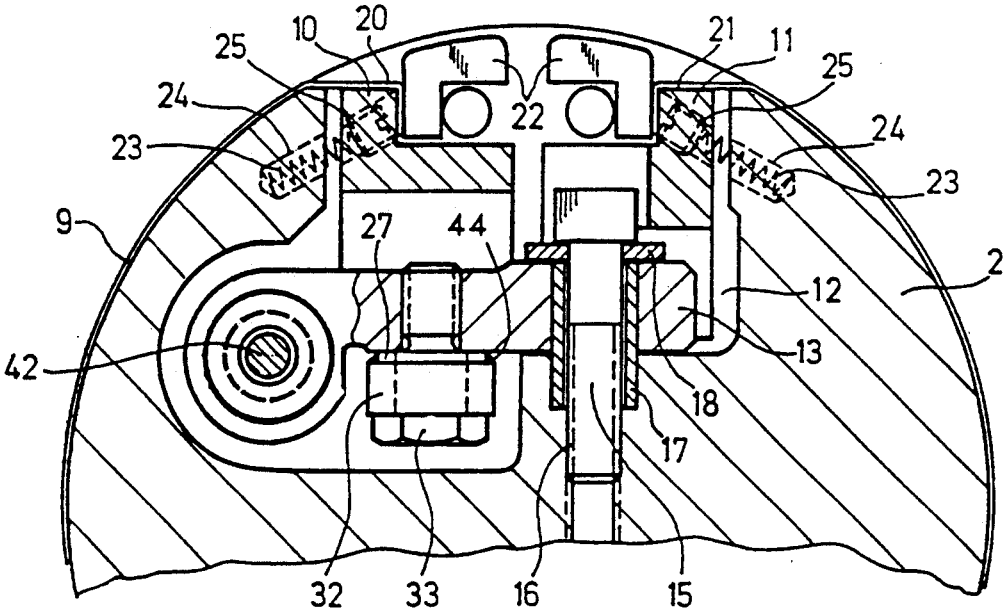
FIG. 3 is a partial, sectional view of the plate cylinder taken along line 3—3 of FIG. 2.
Figure 4:
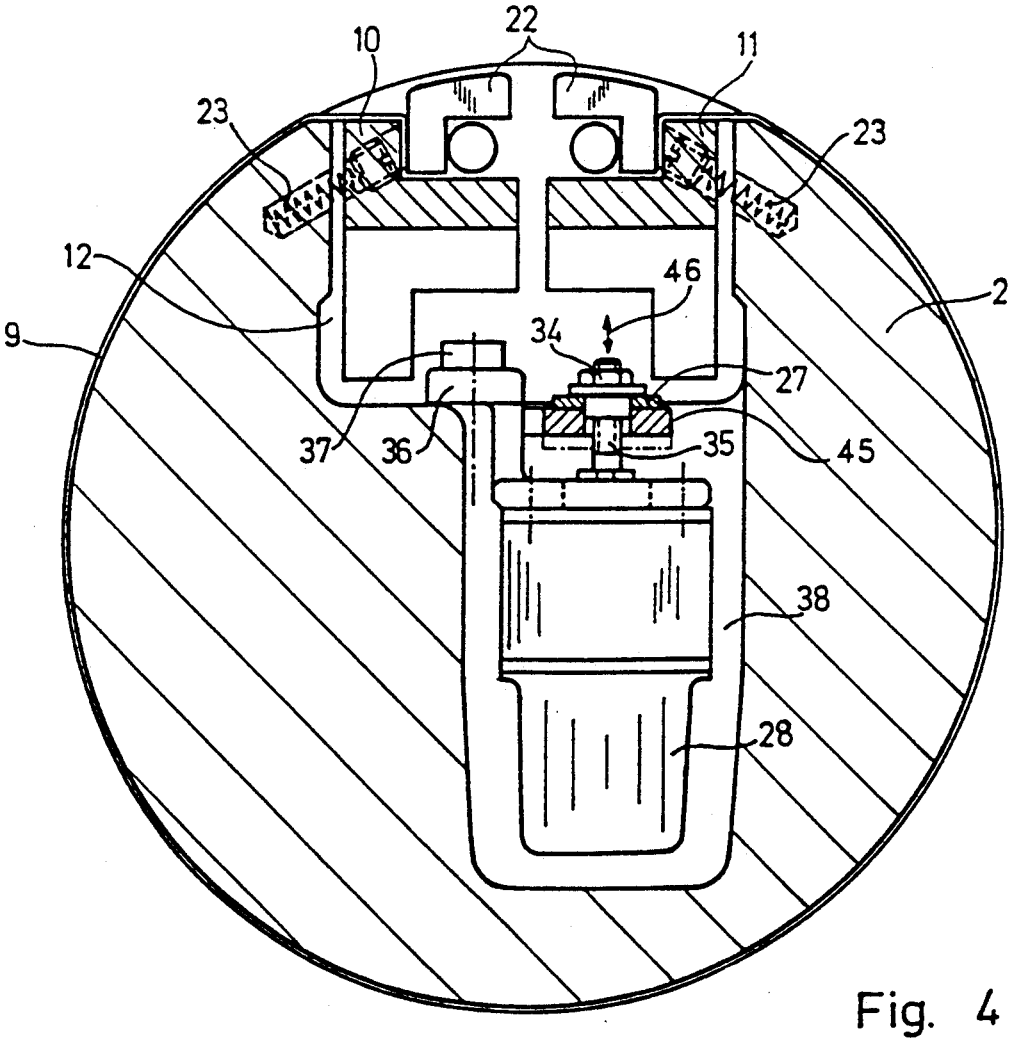
FIG. 4 is a partial, sectional view of the plate cylinder taken along line 4—4 of FIG. 2.

Referring to the drawings and, particularly, to FIG. 1, there is illustrated a plate cylinder 1 that includes a cylinder body 2 having journals 3,4 rotatably supported in the machine side frames 6,7 by bearing 5. Positioned at either end on the cylinder body 2 are cylinder bearers 8 which roll on the cylinder bearers of a cylinder interacting with the plate cylinder 1. A flexible printing plate 9 is clamped on the cylinder body by means of clamping rails 10,11 (FIGS. 3 and 4). Both clamping rails 10,11 are disposed in a longitudinally extending recess 12 formed in the cylinder body 2.

Figure 2:
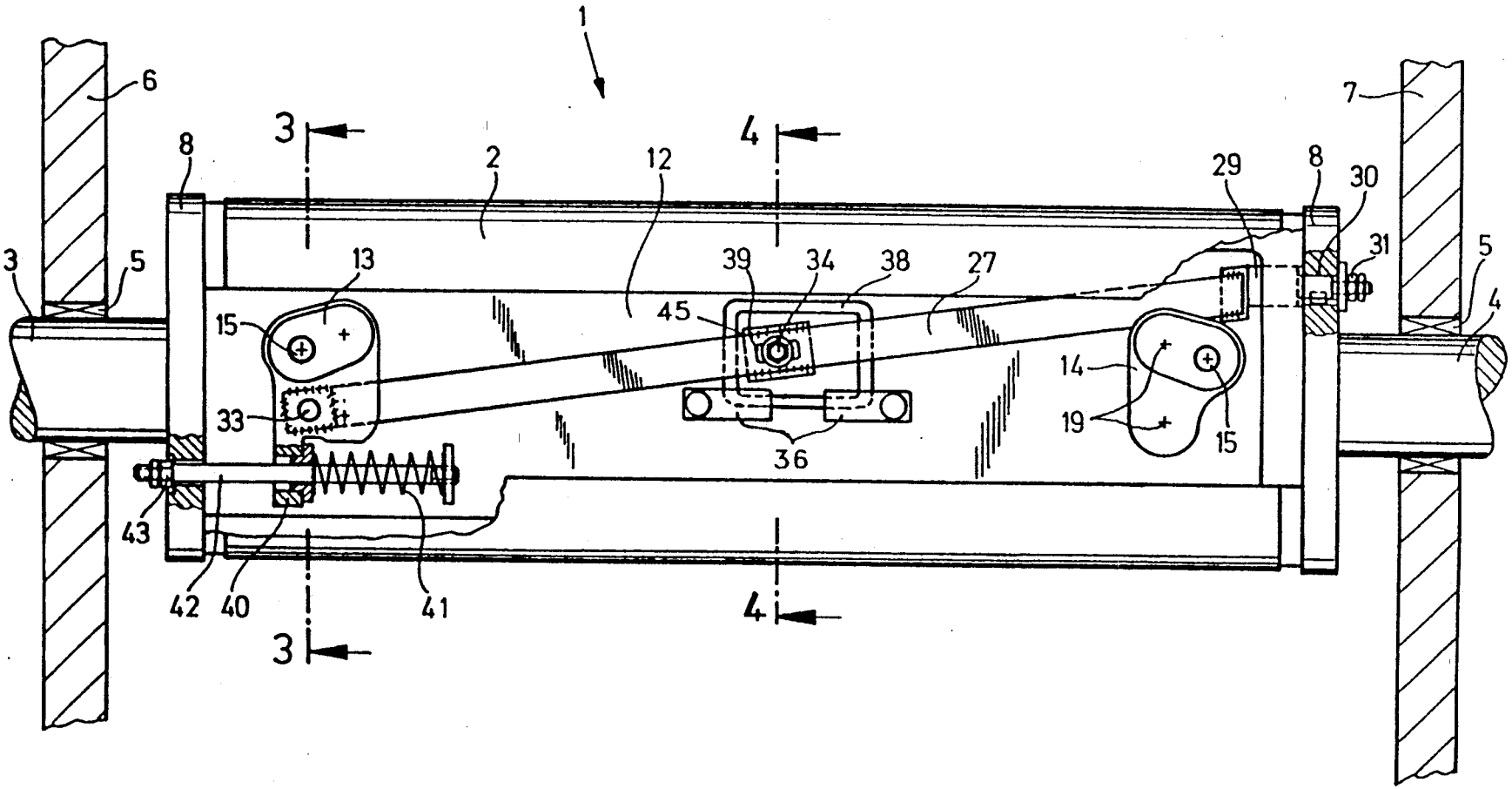
FIG. 2 is a plane view, partially in section, of a device for register connection.

In order to correct the register of the printing plate 9 on the plate cylinder 1, the clamping rails 10,11 are connected to one another in an articulated manner at their respective ends by swivel-mounted levers 13,14. As shown in FIGS. 1 and 2, the swivel-mounted levers 13,14 are held on bearing pins 15 to swivel or pivot in the recess 12 of the cylinder body 2. Each bearing pin 15 is connected to the cylinder body 2 within a threaded bore 16 at the base of recess 12 (FIG. 3). Positioned between bearing pin 15 and each swivel-mounted lever 13,14, concentric with bore 16, is a fitting bushing 17. A disc or washer 18 surrounds pin 15 in abutting relation with the surface of lever 13,14 and the bushing 17. This arrangement guarantees precise guiding of the swivel-mounted levers 13 (FIG. 3).

The swivel-mounted levers 13,14 and the clamping rails 10,11 are connected by zero-play ball-joint bearings 19, as shown in FIG. 1. As a result, precise, zero-play guiding of the two clamping rails 10,11 is guaranteed.

The flexible printing plate 9, which is to be clamped on the outer cylindrical surface of the cylinder, is angled at both its plate end portion 20,21 and is hooked into the clamping rails 10,11 by the angled end portions 20,21. (FIG. 3). The angled plate end portion 20,21 are held in place by pressure pieces 22 to prevent undesired slipping-out from engagement with clamping rails 10,11. In order to clamp the printing plate 9 on the plate cylinder, a plurality of compression springs 23 extend between clamping rails 10,11 and cylinder body 2. The compression springs 23 are disposed in recesses 24 of the cylinder body 2 and in mounts 25 on the clamping rails 10,11. The clamping rails 10,11, which are connected to one another through the swivel-mounted levers 13,14 are adjustable in relation to one another such that, in order to correct the printing plate register, the printing plate 9 is turned about a precisely defined pivot, with the result that, in addition to circumferential-register and lateral-register adjustment, it is also possible to turn the printing plate 9 on the plate cylinder 1. The clamping of the printing plate 9 on the cylinder body 2 is accomplished by pivoting at least one clamping rail 10 through the intermediary of a roller 26 and is accomplished independently of the device according to the invention.

In an advantageous embodiment of the invention as shown in FIGS. 2–4, an element, such as a bending rod 27, is positioned between a swivel-mounted lever 13 and the cylinder body 2 for transmitting a clamping force to the clamping rails 10,11. The bending rod 27 is deflected by an actuating means, such as a servomotor 28 shown in FIG. 4.

The printing plate 9 is clamped in position on the cylinder body 2. The bending rod 27 is disposed in a center position within the recess 12 of cylinder body 2. The rod 27 is stretched between the swivel-mounted lever 13 and a mounting or bracket 29 on the cylinder body 2. When the bending rod 27 is deflected from a straight line position as shown in FIG. 2, there is a change in its length, i.e. there is a shortening of the distance between the mounting 29 and the swivel-mounted lever 13, with the result that the swivel-mounted lever 13 is pivoted about bearing pin 15. Consequently, with the two clamping rails 10,11 being connected to one another by the swivel-mounted levers 13,14, there is a readjustment of the two clamping rails 10,11 in relation to one another. As a result, printing plate 9 turns on the cylinder body 2.

The mounting or bracket 29 is guided in a hole 30 extending through the cylinder body 2 and is engaged outboard of cylinder bearer 8 by adjusting nuts 31. With this arrangement, the bending rod 27 can be aligned in a defined position. The bending rod 27 is connected to the mounting 29 in a suitable manner, such as by welding.

As shown in FIG. 3, at the end of the bending rod 27 opposite the mounting or bracket 29, the bending rod 27 is connected to a bearing body 32, likewise preferably by welding, forming weldment 44. The bearing body 32 is bolted to the swivel-mounted lever 13 by a fit bolt 33 so that pivoting movement of the swivel-mounted lever 13 can be initiated by movement of the bending rod 27 (FIGS. 2 and 3).

Approximately at the center of the bending rod 27, the rod 27 is engaged by an adjusting nut 34, as shown in FIG. 4. The nut 34 is adjustable by means of the threaded spindle 35 of the servomotor 28. The spindle 35 extends through a plate 45 welded to the bottom of rod 27 and up through a slot 39 in rod 27 to threadedly receive nut 34 in engagement with rod 27. With this arrangement, movement of spindle 35 in the direction of arrows 46 moves plate 45 to the position shown in phantom in FIG. 4, bending rod 27 out of a straight line position. The servomotor 28, which may be connected to a speed reducer (not shown), is attached by flanges 36 and bolts 37 to the cylinder body 2 around the recess 12 as shown in FIGS. 2 and 4. An opening 38 in the cylinder body 2, which opening 38 is shown below the recess 12 in FIG. 4, serves to accommodate the servomotor 28. The adjusting nut 34 is disposed in a slot 39 in the bending rod 27 (FIG. 2) and as a result, rod 27 executes an adjusting movement. The tensile forces according to the embodiment described that occur when the bending rod 27 is deflected are so great that, even when clamped in position, the printing plate 9 can be turned on the cylinder body 2 to change the position of the plate on the plate cylinder 1. Instead of utilizing the bending rod 27, it should be understood that other means can be used to transmit tensile or compressive forces to effect register adjustment of the printing plate 9 on the plate cylinder 1.

To avoid any bearing play in lever 13, the swivel-mounted lever 13 is provided with a strap 40 which is engaged by a compression spring 41 shown in FIG. 2. The compression spring 41 is supported on a spring rod 42 which extends through straps 40 and is attached to the cylinder body 2 by adjusting nuts 43. The force of the compression spring 41 counteracts the tensile force of the bending rod 27 so that zero-play adjustment of the printing plate 9 is provided and the swivel-mounted levers 13,14 are returned to their initial positions as shown in FIG. 2.

All the new features disclosed above and shown in the drawings are essential to the present invention, even if they are not expressly claimed in the claims.

In summary, one feature of the invention resides broadly in a device for adjusting the flexible printing plates on the plate cylinder 1 of a rotary printing presses with clamping rails, both ends of the plate 9 being clamped by the clamping rails, with swivel-mounted levers, the clamping rails being connected in an articulated manner at their two ends by the swivel-mounted levers, with the levers being swivellably mounted on swivel on the cylinder body with the thus connected clamping rails being adjustable in relation to one another via control means in such a manner that, in order to correct the register, the printing plate is turned about a precisely defined pivot, characterized in that an element, transmitting a clamping force, is provided between the swivel-mounted lever 13 and the cylinder body 2, the element being deflectable by an actuating means, such that the swivel-mounted lever 13 is turned by the change in length of the element and, consequently, both clamping rails 10, 11 are adjustable in relation to one another.

Another feature of the invention resides broadly in a device characterized in that the element transmitting a clamping force is in the form of a bending rod 27, the bending rod 27 being deflectable out of a straight line by a servo-motor 28 through the intermediary of a threaded spindle 35 with adjusting nut 34.

Yet another feature of the invention resides broadly in a device characterized in that the adjusting nut 34 acts approximately in the center of the bending rod 27.

A further feature of the invention resides broadly in a device characterized in that the bending rod 27 transmits tensile forces and comprises an adjusting device 30, 31 at its mounting 29 on the cylinder body.

A yet further feature of the invention resides broadly in a device characterized in that in order to eliminate bearing play and to reset the swivel-mounted levers, the swivel-mounted lever 13 is engaged by a spring 41, the force of the spring 41 counteracting the tensile force of the bending rod 27.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A device for adjusting the angular positioning of a flexible printing plate on a plate cylinder of a rotary printing press, said adjustment device comprising;

said plate cylinder having a cylinder body and a longitudinally extending recess formed in said cylinder body;

said cylinder body being for supporting the flexible printing plate, the flexible printing plate having opposite end portions for being positioned in said recess, and the printing plate extending around said cylinder body;

a pair of rails positioned in said recess, said pair of rails being aligned substantially parallel to one another;

each said rails of said pair of rails being provided with attachment means for attaching one of the opposite end portions of the flexible printing plate thereto;

a swivelable member pivotally mounted on said cylinder body at a pivot point within said recess for joining said rails in an articulated fashion to thereby change the position of the printing plate on said cylinder body through the parallel relative displacement of said rails, said rails being pivotally connected to said swivelable member on opposite sides of said pivot point;

a deflectable member, said deflectable member being connected, at one end thereof, to said cylinder body and, at the other end thereof, to said swivelable member; and actuating means connected to said deflectable member for bending said deflectable member to turn said swivelable member and longitudinally displace said rails relative and parallel to one another to thereby adjust the position of the printing plate on said plate cylinder.

2. The device according to claim 1, further including;

means for pivotally mounting said swivelable member on said cylinder body within said recess.

3. The device according to claim 1, further including;

compressive means extending between said plate cylinder and said swivelable member for extending a force on said swivelable member to maintain said rails in a preselected position relative to one another.

4. The device according to claim 1, wherein;

said swivelable member includes a pair of levers pivotally mounted on said cylinder body being spaced from one another longitudinally along said recess.

5. The device according to claim 4, wherein;

said pair of levers are connected to each of said rails such that pivotal movement of one of said pair of levers initiates movement of said rails relative to one another to move the printing plate on said plate cylinder.

6. The device according to claim 4, further including;

bearing means for connecting said pair of levers to said rails so that said rails move in response to pivotal movement of said pair of levers on said cylinder body.

7. The device according to claim 1, wherein;

said deflectable member includes an elongated member having a first end portion connected to said cylinder body and an opposite second end portion connected to said swivelable member;

said actuating means being connected intermediate, first and second end portions of said elongated member; and said elongated member being deflected in a preselected direction upon actuation of said actuating means to turn said swivelable member and displace the relative position of said rails for changing the position of the printing plate on said plate cylinder.

8. The device according to claim 7, further including;

means for adjustably connecting said elongated member to said actuating means.

9. The device according to claim 1, wherein;

said actuating means includes a servomotor secured to said cylinder body below said recess; and said actuating means includes a spindle connected to said deflectable member such that, upon actuation of said servomotor, said spindle is moved to exert a displacing force upon said deflectable.

10. The device according to claim 9, further including;

means for adjusting the connection of said spindle to said deflectable member.

11. A device for adjusting the angular positioning of a flexible printing plate mounted on a plate cylinder of rotary printing press comprising;

a plate cylinder having a cylinder body and a longitudinally extending recess formed in said cylinder body;

said cylinder body being for supporting the flexible printing plate, the flexible printing plate having opposite end portions for being positioned in said recess the flexible printing plate extending around said cylinder body when mounted thereon;

a pair of rails positioned in said recess for being in abutting relation with the printing plate opposite end portions respectively and for holding the printing plate on said plate cylinder;

a pair of levers pivotally mounted on said cylinder body within said recess;

means for connecting said levers to said rails such that pivotal movement of a selected one of said levers initiates movement of both of said rails; and displacement means connected to said levers to turn said levers relative to said plate cylinder with a force sufficient to move said rails to displace said printing plate on said plate cylinder;

said displacement means comprising a member having a first distal end and a second distal end, said first distal end of said member being secured to said cylinder body, and said second distal end of said member being attached to one of said pair of levers;

said displacement means further comprising means for altering the longitudinal distance between said first and second distal ends of said member.

12. A device according to claim 11, wherein said member comprises a bendable bar, and wherein said displacement means additionally comprises means for inducing a bending moment in said bar to thereby cause said bar to assume an at least partially arcuate shape and thereby reduce said longitudinal distance between said first and second distal ends.

13. A device according to claim 11, further including means for stabilizing the position of said levers on said cylinder body in response to actuation of said displacement means.

14. A device according to claim 11, further including;

bearing means for connecting each of said levers to said rails such that movement of a selected one of said levers moves both of said rails.

15. A device according to claim 11, further including;

a servomotor drivingly connected to said displacement means for moving said displacement means to initiate pivotal movement of said levers and corresponding movement of said rails.

16. A device for adjusting the angular positioning of a flexible printing plate on a plate cylinder of a rotary printing press having tension rails, the flexible printing plate having end portions secured to said tension rails, said device comprising;

a control lever flexibly connected to said tension rails on both ends thereof whereby said control lever is attached to said plate cylinder in a swivel-type fashion;

said tension rails being adjustable relative to each other for altering the register of a printing plate on said plate cylinder; and link means extending between said control lever and said plate cylinder for transferring tension to said tension rails whereby a change in length of said link means rotates said control lever and thusly changes the position of said tension rails relative to each other.

17. The device according to claim 16, wherein;

said link means is a flexible rod, and a motor having a spindle connected to said rod for changing the position of said rod upon operation of said motor.

18. A device according to claim 17 further including;

adjustment means for connecting said rod to said motor spindle.

19. The device according to claim 18 wherein;

said flexible rod transfers tensile force through said control lever to said tension rails.

20. The device according to claim 17 further including;

spring means acting upon said control lever for counteracting the tensile force of said rod.

* * * * *